US012004581B2

(12) United States Patent
Maier

(10) Patent No.: US 12,004,581 B2
(45) Date of Patent: Jun. 11, 2024

(54) CYCLING GARMENT

(71) Applicant: Assos of Switzerland GmbH, San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 136 days.

(21) Appl. No.: 16/421,604

(22) Filed: May 24, 2019

(65) Prior Publication Data

US 2019/0357600 A1 Nov. 28, 2019

(30) Foreign Application Priority Data

May 25, 2018 (EP) ..... 18174247

(51) Int. Cl.
*A41F 3/02* (2006.01)
*A41D 1/084* (2018.01)
*A41F 3/06* (2006.01)

(52) U.S. Cl.
CPC ..... *A41F 3/02* (2013.01); *A41D 1/084* (2013.01); *A41F 3/06* (2013.01); *A41D 2600/104* (2013.01)

(58) Field of Classification Search
CPC ... A41D 1/084; A41F 3/00; A41F 3/06; A41F 3/02; A41F 11/02; A41F 11/10
USPC ..... 2/326
See application file for complete search history.

(56) References Cited

U.S. PATENT DOCUMENTS 144,091 A * 10/1873 Hamm ..... A41F 3/00 2/326
717,392 A * 12/1902 Guiterman ..... A41F 3/00 24/698.3
2,030,791 A * 2/1936 Hickok ..... A41F 3/00 2/326
2,136,092 A * 11/1938 Troy ..... C14B 1/00 156/254
5,054,128 A * 10/1991 Wimmer ..... A41F 3/02 2/300
5,129,105 A * 7/1992 Kleinman ..... A41D 31/085 2/328
6,918,140 B1 * 7/2005 Cooper ..... A41D 1/084 2/228
2007/0192940 A1 * 8/2007 Waters ..... A41F 3/00 2/326
2013/0091621 A1 * 4/2013 Lu ..... A41F 3/00 2/326
2013/0247282 A1 * 9/2013 Herman ..... A41F 19/00 2/327
2015/0257460 A1 * 9/2015 Maier ..... A41F 3/00 2/230
2015/0342272 A1 * 12/2015 Bonime ..... A41D 13/02 2/230

(Continued)

FOREIGN PATENT DOCUMENTS

DE 102006022576 A1 12/2006
JP 2017197869 A 11/2017

*Primary Examiner* — Megan E Lynch
(74) *Attorney, Agent, or Firm* — Fox Rothschild LLP

(57) ABSTRACT

A cycling bib (1) comprising a trousers member (2) and an elastically stretchable suspender member (3), wherein the suspender member comprises a stiffer portion (8) compared to the remaining of the suspender member, according to at least one stretching direction, said stiffer portion (8) being located in the rear lower region of the suspension member.

6 Claims, 1 Drawing Sheet

(56) References Cited

U.S. PATENT DOCUMENTS

2016/0295943 A1* 10/2016 Gilroy ..... A41F 3/00
2017/0348579 A1* 12/2017 Morelius ..... A63B 69/3608

* cited by examiner

CYCLING GARMENT

FIELD OF THE INVENTION

The invention relates to the field of cycling garments. More in detail, the invention relates to a cycling bib, which is a cycling garment including suspenders.

PRIOR ART

A cycling bib includes basically a trousers member and a suspender member. A common embodiment has short trousers and is termed bib shorts. Like other cycling garments, the cycling bibs normally include a seat pad, also named chamois. The seat pad is located in the crotch area and is designed to provide a proper cushioning and support.

The suspender member of a cycling bib is an integral part of the garment, i.e. it is integrally formed with, or permanently attached to, the trousers member. The suspenders of a cycling bib, in other words, are not removably attached to the trousers with buttons, connectors or the like.

An advantage of a cycling bib is the absence of a waistband. The waistband is a source of discomfort for some riders. For example a waistband put pressure on the abdomen and restricts breathing. In addition, a waistband tends to lose elasticity and slip down, which results in poor adherence of the seat pad to the body. In a cycling bib, the suspenders eliminate the need of a waistband and maintain a good fitting over time.

Cycling trousers with a seat pad are known in the art. Among others, a background art can be found in EP 2 810 574 disclosing a cycling suit with a seat pad, and EP 2 918 182 disclosing a cycling bib with integrally formed X-shaped suspenders.

A proper positioning of the trousers and of their seat pat is of the utmost importance. Particularly, there is an effort to carefully tailor the design of cycling garments to provide the best fitting when the user is in the riding position. If a seat pad deviates from the correct position and/or does not adhere to the body, the cushioning and support performance deteriorates rapidly. This is particularly the case of seat pads of elaborated design. For example, a seat pad of a high-end cycling bib may have a complex anatomical shape with differentiated features, e.g. differentiated padding zones. A seat pad of such a complex design requires accurate and stable position to deliver the best performance. Ensuring such proper positioning of the seat pad under all conditions is not an easy task.

The invention aims to still improving the performance of cycling bibs in this regard.

SUMMARY OF THE INVENTION

The aim of the invention is reached with a cycling bib according to claim 1.

The cycling bib comprises a trousers member and an elastic suspender member and is characterized in that the suspender member comprises a stiffer portion compared to the remaining of the suspender member, according to at least one stretching direction, said stiffer portion being located in the rear lower region of the suspender member.

The invention provides that the suspender member has a differentiated stiffness, particularly with a rear lower portion which is less stretchable, for a given force, than the remaining of the suspender member.

Said stiffer portion has a greater stiffness than the rest of the suspension member in at least one stretching direction.

Said at least one stretching direction is preferably a direction of elongation of the suspender portion, when the bib is worn.

The term stiffness denotes the resistance offered to elastic deformation, that is the ratio of force over displacement, e.g. Newton per meter (N/m).

According to various embodiments, said at least one stretching direction may include the longitudinal axial direction of one or more suspender straps of the suspender member. In some embodiments, said rear lower portion of the suspender member is made stiffer in all directions.

The term straps denote elongated portions of the suspender member, for example elastic bands.

In some embodiments, said stiffer portion of the suspender member is located below an intermediate joint. Said intermediate joint may be a transition joint between a more deformable portion and a stiffer, less deformable portion of the suspender member.

Said intermediate joint may include a panel, for example a fabric panel, or can be a point of connection of different straps of the suspender member.

In an embodiment, said stiffer portion of the suspension member extends from at least one rear attachment with the trousers member, up to said intermediate joint.

In an embodiment, said intermediate joint is located in the middle or substantially in the middle of a rear part of the suspender member.

In an embodiment, the suspender member comprises a first portion and a second portion; the first portion extends from at least one front attachment with the trousers member up to said intermediate joint; the second portion represents said stiffer portion, extending from the intermediate joint to at least one rear attachment.

In an embodiment, said first portion of the suspender member comprises two suspender straps, each having a first end attached to the trousers member and an opposite second end attached to said intermediate joint, and the second portion (stiffer portion) of the suspender member comprises at least one strap having a first end attached to the intermediate joint and a second end attached to the trousers member.

In an embodiment, said second portion of the suspender member comprises two straps, each having one end attached to the intermediate joint and one opposite end attached to the trousers member.

In a preferred embodiment, the first portion and the second stiffer portion of the suspender member have two straps each. All straps converge towards the intermediate joint so that the suspender member is generally X-shaped. In a variant, the stiffer portion may include a single strap, to that the suspender member appears generally Y-shaped.

In an embodiment, the stiffer portion includes two straps which extend from the intermediate joint towards the trousers member, according to diverging directions, thus forming a lambda (A) shaped rear portion.

In an embodiment, the stiffer portion includes two straps which are attached to the trousers member along attachment lines inclined relative to a median crotch line of the trousers member.

In an embodiment, said two straps are two separate bands. In another embodiment, said two straps are part of a single band. In an embodiment, an elastic band is folded in proximity of the joint member to form the two straps of the lower-back stiffer portion of the suspender member.

In an embodiment, said stiffer portion has attachments to the trousers member located below the front attachments of the suspender member, relative to a waist line of the cycling bib.

An embodiment of the invention is a cycling bib comprising a pair of trousers; a first pair of suspenders, having first ends attached to the front of the trousers and opposite second ends attached to a back joint; a second pair of suspenders having first ends attached to the back joint and opposite second ends attached to the rear of the trousers; wherein the second pair of suspenders has a greater stiffness, in a longitudinal direction of elongation, than the first pair.

The greater stiffness can be obtained with a specific material and/or structure. According to embodiments of the invention, said stiffer portion of the suspender member can be made of a different material and/or have a different structure (e.g. a greater thickness) than the other portion(s) of the suspender member. For example, in an embodiment, the stiffer portion is made of a fabric material including a smaller amount of elastane than the material of the rest of the suspender member.

In an embodiment, the stiffer portion of the suspender member is made of a material with a greater elastic modulus compared to the remaining of the suspender member, the elastic modulus being greater at least in the above mentioned stretching direction.

The elastic modulus ($N/m^2$) is a parameter known to the skilled person and denotes the ratio between stress and strain. Said elastic modulus may be the Young's modulus in the above mentioned stretching direction.

In a preferred embodiment, said stiffer portion of the suspender member has a stiffness which is at least 10% greater than the stiffness of any other portion of the suspender member, according to said at least one stretching direction.

The suspender member is a structural part of the cycling bib and is permanently attached to the trousers member. A permanent attachment is understood as an attachment which cannot be removed by the user without damage. For example the suspender member is stitched or welded to the trouser member.

In some embodiments, one or more straps of the suspender member can be integrally formed with the trousers member, or a panel thereof. Accordingly, the attachment region of one or more straps may be a transition region between the trousers member and the respective strap.

The trousers member preferably includes a seat pad. Said seat pad can be realized in itself according to known art and said seat pad preferably comprises a base panel (also termed cover) and one or more pads made of a soft material and fixed to the base panel. Preferably the seat pad comprises at least to symmetrically arranged pads. The base panel may comprise one or more layers.

In some embodiments, the stiffer portion is attached to directly to the seat pad of the cycling bib. For example, the above mentioned two straps of the stiffer portion are attached directly to the seat pad. Preferably, the stiffer portion is attached to the base panel of the seat pad.

In an embodiment, the suspender member includes two front straps made of a first material and at least one rear lower strap made of a second material, said second material having a greater elastic modulus than the first material, according to a direction of longitudinal elongation of said straps. The first material can be the same material of the trousers member, in a preferred embodiment.

A preferred material for the bib of the invention is elastane fibre.

The advantages of the invention are the following. The stiffer rear lower portion of suspenders performs as a stabilizer of the cycling bib. Particularly, the stiffer rear lower portion delivers a stabilizing traction on the trousers and helps keeping the trousers and seat pad properly in place. In a conventional cycling bib, the traction on the trousers is provided by the shoulders of the user, and is transferred via a relatively long elastic strap between the shoulders and the connection point with the trousers. With the present invention, the traction point is moved downwards and closer to the trousers and traction is transferred via a rear stabilizer, stiffer and less deformable than the rest of the structure; as a result, the trousers and the seat pad are stabilized and adherence to the body is enhanced.

A cycling bib of the invention has suspenders with differentiated elasticity, wherein a part with increased stiffness is strategically located in the rear end region. The applicant has found that this differentiated elasticity is particularly effective in terms of good adherence and stability of the seat pad even under intense cycling.

The features and the advantages of the invention will be further elucidated with the help of the following detailed description, which is given for indicative and not limiting purpose, and with the help of the figures.

DETAILED DESCRIPTION

Figure 1:
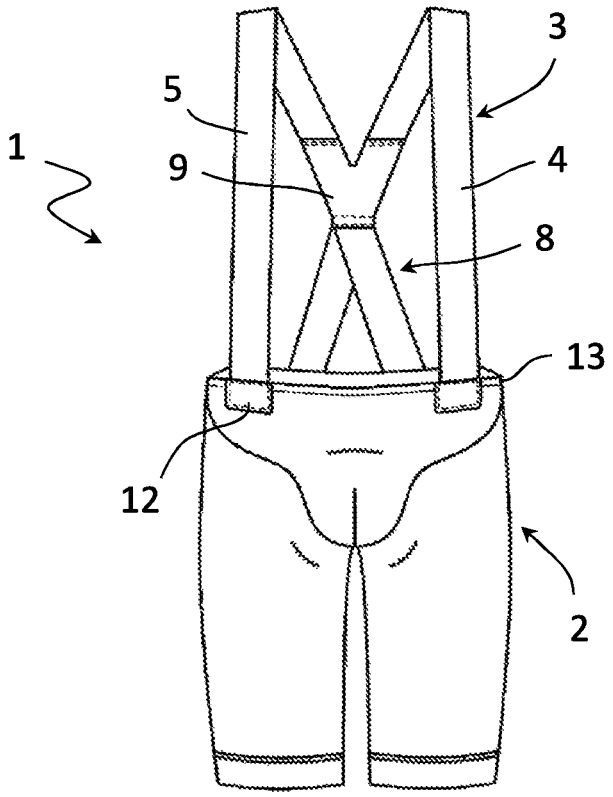
FIG. 1 is a front view of a cycling bib according to an embodiment of the invention.
Figure 2:
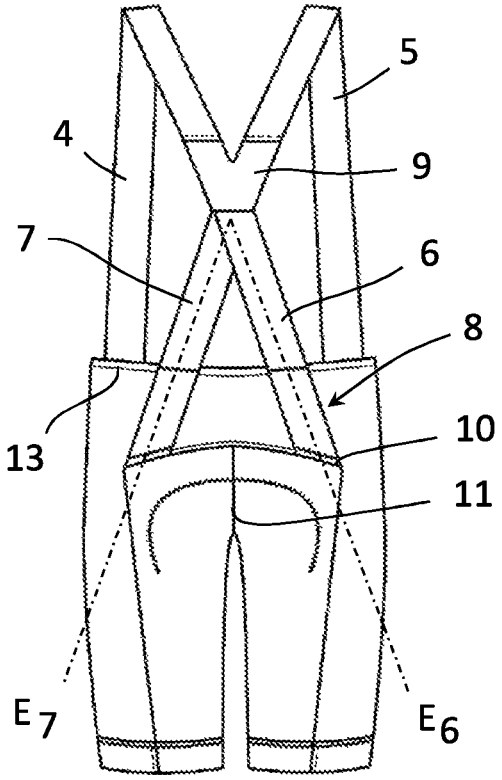
FIG. 2 is a rear view of the bib of FIG. 1.

FIGS. 1 and 2 illustrate a cycling bib 1 comprising a trousers member, generally denoted by numeral 2, and an elastic suspender member generally indicated by the numeral 3.

The trouser member 2 for example takes the form of a pair of shorts. The shorts 2 may include a seat pad (not shown) located internally in the crotch area. The seat pad may comprise a base panel and one or more soft pads.

The suspender member 3 includes a pair of front suspender straps 4, 5 and a pair of rear suspender straps 6, 7. The rear suspender straps 6, 7 form a rear lower portion 8 of the suspender member 3 (FIG. 2).

The suspender member 3 also includes a joint panel 9 in the mid-rear region. Preferably, said panel 9 is located at a suitable point of the suspender member 3, so that it lies substantially in the middle of the back of the user, when the bib 1 is worn.

The front suspender straps 4, 5 have first ends attached to the shorts 2 and opposite second ends attached to the joint panel 9. Similarly, the rear suspender straps 6, 7 have first ends attached to the back of the shorts 2 and second ends attached to said panel 9.

Preferably, the suspenders converge to the panel 9 so that the suspender member 3, particularly the rear part, has the shape of an X, as best seen in FIG. 2.

The rear suspender straps 6, 7 are stiffer than the front straps 4, 5. More in detail, the rear straps 6, 7 are stiffer than the front straps 4, 5 according to the longitudinal stretching direction of the straps. For example FIG. 2 illustrates the longitudinal stretching directions E6 and E7 of the strap 6, 7.

The rear suspender straps 6, 7 may be elastic bands or part of a single elastic band, folded in the proximity of the joint panel 9, according to preferred embodiments.

In a preferred embodiment, the shorts 2 and the front straps 4, 5 are made of a first fabric material and the rear straps 6, 7 are made of a second material, which is stiffer than the first material.

The figures show a preferred embodiment wherein said two straps 6, 7 of the stiffer portion 8 are attached to the trousers member 2 along attachment lines 10 which are inclined relative to a median crotch line 11 of the trousers member. Even more preferably, the rear attachment lines 10 are situated below front attachment lines 12 of the suspender member 3, relative to a waistline 13 of the bib 1.

Also, it can be seen that the rear straps 6, 7 extend at angled directions from the joint 9, thus forming a lambda- or inverted V-shaped rear stabilizer.

Due to the stiffness of the straps 6 and 7, the rear lower portion 8 (rear stabilizer) will exhibit a smaller elongation, for a given traction force, than the remaining of the suspender member 3. Particularly, the elongation of the rear lower portion 8 is smaller than the elongation of the front straps 4 and 5, for a given force.

The straps 6, 7, being less deformable, deliver traction forces on the shorts 2, according to the directions E6 and E7, the joint 9 acting as a traction point. Accordingly, said lower portion 8 provides a stabilization effect of the shorts 2 under intense pedalling action. If the shorts 2 include a seat pad, the portion 8 also stabilizes the position of the seat pad and improves the adherence to the body. The action of the rear stabilizer 8 is particularly effective when the user is in the riding position.

The invention claimed is:

1. A cycling bib (1) comprising a trousers member (2) and an elastic suspender member (3) attached to the trousers member, wherein the trousers member has a seat pad located internally in the crotch area of the trousers member wherein the suspender member comprises two front straps (4, 5) and two rear straps (6, 7), said rear straps forming a rear lower portion (8) of the suspender member, wherein said front straps and said rear straps are elastically stretchable and entirely made of elastic material, said rear straps being less stretchable than the front straps according to a longitudinal direction of the straps, said rear straps being located in the rear lower region of the suspender member, wherein the front straps and the rear straps connect at a joint (9) of the suspender member, wherein the front straps have front ends attached directly to the trouser member; said joint being a fabric panel where the front straps and the rear straps are permanently attached, each of said two rear straps is attached to the trousers member at a first attachment and at a second attachment, the first attachment being located at a waistline (13) of the trousers member, the second attachment being located below said waistline, the second attachment of each rear strap being made along an attachment line (10) inclined relative to a median crotch line (11) of the trousers.

2. The cycling bib according to claim 1, wherein said joint is located substantially in the middle of a rear part of the suspender member.

3. The cycling bib according to claim 1, wherein said front straps and said rear straps converge towards said joint so that the suspender member is generally X-shaped.

4. The cycling bib according to claim 1, wherein said rear straps have a stiffness according to said longitudinal direction which is at least 10% greater than the stiffness of any other portion of the suspender member.

5. The cycling bib according to claim 1, wherein the suspender member is permanently attached to the trousers member.

6. The cycling bib according to claim 1, wherein the suspender member comprises an elastic band which is folded over below said joint to form said rear straps.

* * * * *